United States Patent [19]

Allen et al.

[11] 4,405,017

[45] Sep. 20, 1983

[54] POSITIVE LOCATING EXPENDABLE PLUG

[75] Inventors: Richard G. Allen, Houston; Mark C. Glaser, Bellaire, both of Tex.

[73] Assignee: Baker International Corporation, Orange, Calif.

[21] Appl. No.: 308,688

[22] Filed: Oct. 2, 1981

[51] Int. Cl.[3] ..... E21B 23/03

[52] U.S. Cl. ..... 166/382; 166/125; 166/135; 285/3

[58] Field of Search ..... 166/382, 135, 192, 123, 166/124, 125, 377, 327, 328, 181, 182; 285/18, 317, 39, 2, 3 A

[56] References Cited

U.S. PATENT DOCUMENTS

| | | | |
|---|---|---|---|
| 2,894,586 | 7/1959 | Schramm et al. | 166/125 |
| 3,148,894 | 9/1964 | Schwab | 285/3 |
| 4,307,902 | 12/1981 | Schnatzmeyer | 285/3 |

*Primary Examiner*—Ernest R. Purser
*Assistant Examiner*—Michael Starinshy
*Attorney, Agent, or Firm*—Norvell & Associates

[57] ABSTRACT

This invention relates to an expendable tool, such as a plug assembly, which may be locked within a tubular member, such as a packer assembly, located within a well casing, and a method of locating and releasing same. The plug assembly comprises a main housing adapted to support a plurality of circumferentially spaced, radially retractable locking segments. A longitudinally extending mandrel is slidably mounted within the housing and is axially shiftable from an first position, wherein the mandrel maintains the locking segments outwardly within a cooperating groove formed in the packer assembly, to a second position, wherein the locking segments are permitted to move out of engagement with the well packer. A collet sleeve is secured to the mandrel by a shear pin and maintains the mandrel in the upper position. When it is desired to release the plug from the packer assembly, an actuating sleeve is attached to the lower end of a tubing string and run down the well casing to be engaged by the collet sleeve. A predetermined amount of upward force is applied to the collet sleeve by the actuating sleeve to shear the shear pin and release the mandrel from the upper position. By monitoring the upward force required to release the mandrel from its upper position, an operator is provided with a positive indication that the tubing guide has located the plug. Thereafter, a downward force applied to the mandrel will shift the mandrel to the lower position to retract the locking segments and expend the plug from the packer assembly.

26 Claims, 5 Drawing Figures

POSITIVE LOCATING EXPENDABLE PLUG

BACKGROUND OF THE INVENTION

1. Field of the Invention

The present invention relates in general to tools for use in well packer asemblies, and in particular to expendable plugs of the type which are disengaged from a well packer by forces generated through a tubing string.

2. Description of the Prior Art

Typically, plug assemblies for use in subterranean wells are utilized in combination with a packer assembly and are selectively located within a well casing in order to isolate one or more of the production zones of the well. The plug assembly is mounted within a packer assembly at the well head and the entire unit is run down the well casing and secured at a selected location along the casing. When it is desired to release the plug from the packer assembly, a tubing string having a suitable actuator attached to the lower end thereof is run down the well casing to contact the plug. Typically, by applying sufficient downward force to the plug, the plug becomes disengaged from the packer assembly and free falls to the bottom of the well. An example of such an expendable plug is disclosed in U.S. Pat. No. 4,188,999 to A. Amancharia.

While an expendable plug of the type disclosed in the above mentioned patent has proved advantageous in many instances, there are certain instances which may create some problems for the operator. For example, if a measurable amount of sand has accumulated on top of the plug, and the tubing string is lowered to disengage the plug, the tubing string will rest on top of the sand. Although typically a downward force transmitted to the plug through a small amount of sand may be sufficient to release the plug, the operator has no indication at the well head whether the tubing string has actually contacted the plug or whether the tubing string is resting on a substantial depth of sand. Consequently once the plug is released, the operator will have no indication as to the location of the lower end of the tubing string relative to the packer assembly. Since the lower portion of the tubing string is typically provided with external seals to be positioned within the packer assembly after the plug is released, it is difficult for the operator to properly position the external seals within the packer.

One type of prior art expendable plug which is not released upon the initial application of a downward force to the plug is a screw-out plug of the type manufactured by Pengo Industries, Inc. of Forth Worth, Texas. In order to release this type of plug, an actuator attached to the tubing string is lowered down the well casing to engage the plug. After the plug has been contacted, the actuator is rotated to release the plug from the packer. However, the operator is not provided with any initial indication that the actuator has actually located the plug.

SUMMARY OF THE INVENTION

The present invention relates to a tool, such as an expendable plug assembly, which is released from a tubular member, such as a packer assembly in such a manner so as to provide the operator with a positive indication that the tubing string has actually located the plug. This indication is provided by requiring a predetermined upward force to be applied to the plug by the tubing string before a downward force can be used to release the plug from the packer.

The plug assembly includes a main housing which is utilized to support a plurality of circumferentially spaced, radially shiftable locking segments. In the preferred embodiment, the locking segments can be maintained in a radially outward position by means of an inner mandrel slidably mounted within the housing. The locking segments are received within a cooperating annular groove formed in the packer assembly for securely locking the plug within the packer. The mandrel is shiftable from an upper position wherein the locking segments are maintained outwardly in engagement with the packer assembly to a lower position wherein the locking segments can be retracted to release the plug from the packer assembly. The plug assembly also includes seal means on the main housing for preventing fluid transmission across the plug.

A positioning means, such as a collet sleeve, is positioned over the upper end of the mandrel, and rests on the housing and is releasably secured to the mandrel by means of a first shear pin. In order to shift the mandrel downwardly to its second position, an upward force must first be applied to the collet sleeve by the tubing string to shear the first shear pin permitting the collet sleeve to telescope upward relative to the mandrel. By monitoring the upward force required to disengage the mandrel and the collet sleeve, the operator can determine whether or not the tubing string has located the plug.

Both the collet sleeve and the mandrel are provided with ratchet means or wickers which, after the first shear pin has been sheared, can be engaged by upward movement of the collet sleeve to securely lock the collet sleeve to the mandrel. A downward force thereafter applied to the collet sleeve by the tubing string causes the mandrel to shift downwardly to its lower position. Downward movement of the mandrel shifts a split sleeve member, initially holding the locking segments in their radially engaged position, to dislodge the locking segments thereby permitting the plug to be released from the packer.

In certain instances it may be desirous to retrieve the tubing string from the well for space out purposes after the first shear pin has been sheared but before the mandrel has been shifted downwardly to release the plug. The present invention provides an actuating sleeve which can be utilized to further assure the operator by visual inspection that he has contacted the plug. The actuating sleeve includes a hollow main body attachable to the bottom of a tubing string and having a locating sleeve releasably secured to the inner wall thereof by means of a second shear pin. The locating sleeve has an upwardly facing shoulder which is engageable with downwardly facing shoulders on the collet arms in order to produce the required upward force to shear the first shear pin between the collet sleeve and the mandrel. Further upward force generated on the tubing string causes the second shear pin between the main body of the tubing guide and the locating sleeve to shear, thereby releasing the locating sleeve from the tubing guide and providing the operator with a second signal. Thus, when the tubing string is retrieved from the well casing, the operator can examine the actuating sleeve to determine whether or not the locating sleeve has remained downhole with the plug, and if it has, the re-inserted tubing string will directly engage the interlocked collet sleeve and mandrel to force it downward to release the plug.

DESCRIPTION OF THE PREFERRED EMBODIMENT

Figure 1:
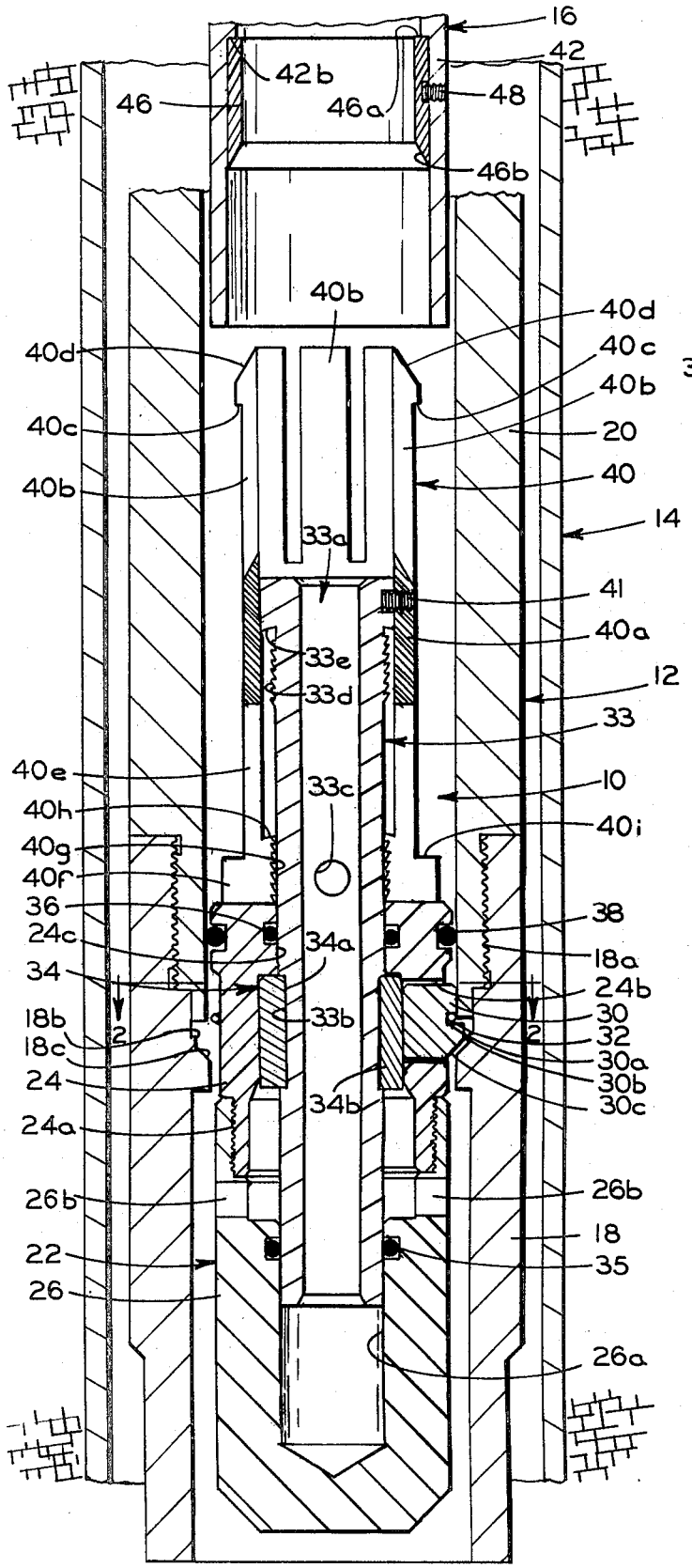
FIG. 1 is a sectional view taken through a well casing and showing the lower portion of a packer assembly in which is located an expendable plug embodying the principles of the present invention.

Referring now to FIG. 1, there is shown an expendable plug assembly 10 embodying the principles of the present invention which is locked within a packer assembly 12 located within a well casing 14. Typically, the plug assembly 10 and the packer assembly 12 are positioned at a predetermined location along the well casing 14 to provide fluid isolation between an upper and lower production zone of a well. Also shown in FIG. 1 is an actuating sleeve 16 which, as will be discussed, is attached to a tubing string and utilized to release the plug assembly 10 from the packer assembly 12.

The packer assembly 12 includes a bottom packer guide 18 which is threadably secured at 18*a* to an upper packer body 20. The upper packer body 20 is provided with a conventional slip assembly (not shown) which expands radially outwardly from the body 20 to grip the interior of the well casing 14 for securely mounting the packer assembly 12 at a selected location along the well casing 14. The upper body 20 is also provided with a sealing unit (not shown) for preventing fluid flow through the well casing 14 along the outside of the packer assembly 12.

Figure 2:
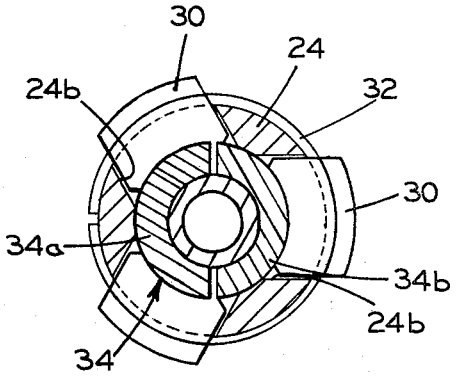
FIG. 2 is a sectional view of the plug taken along the plane 2—2 of FIG. 1.

The expendable plug assembly 10 includes a main housing 22 consisting of an upper locking segment portion 24 and a lower plug portion 26 which are secured together to form a unitary body by threads 24*a*. As shown in FIG. 2, the locking segment portion 24 is provided with a plurality of circumferentially spaced, radial openings 24*b* for receiving a plurality of locking segments 30. Each locking segment 30 includes an outer annular groove 30*a* for receiving a snap ring 32 which maintains the segment 30 within its associated opening 24*b*. Each locking segment 30 further includes an outer annular rib portion 30*b* below the groove 30*a* which extends downwardly and inwardly to form a downwardly facing inclined surface 30*c*.

Figures 3A, 3B, 3C:
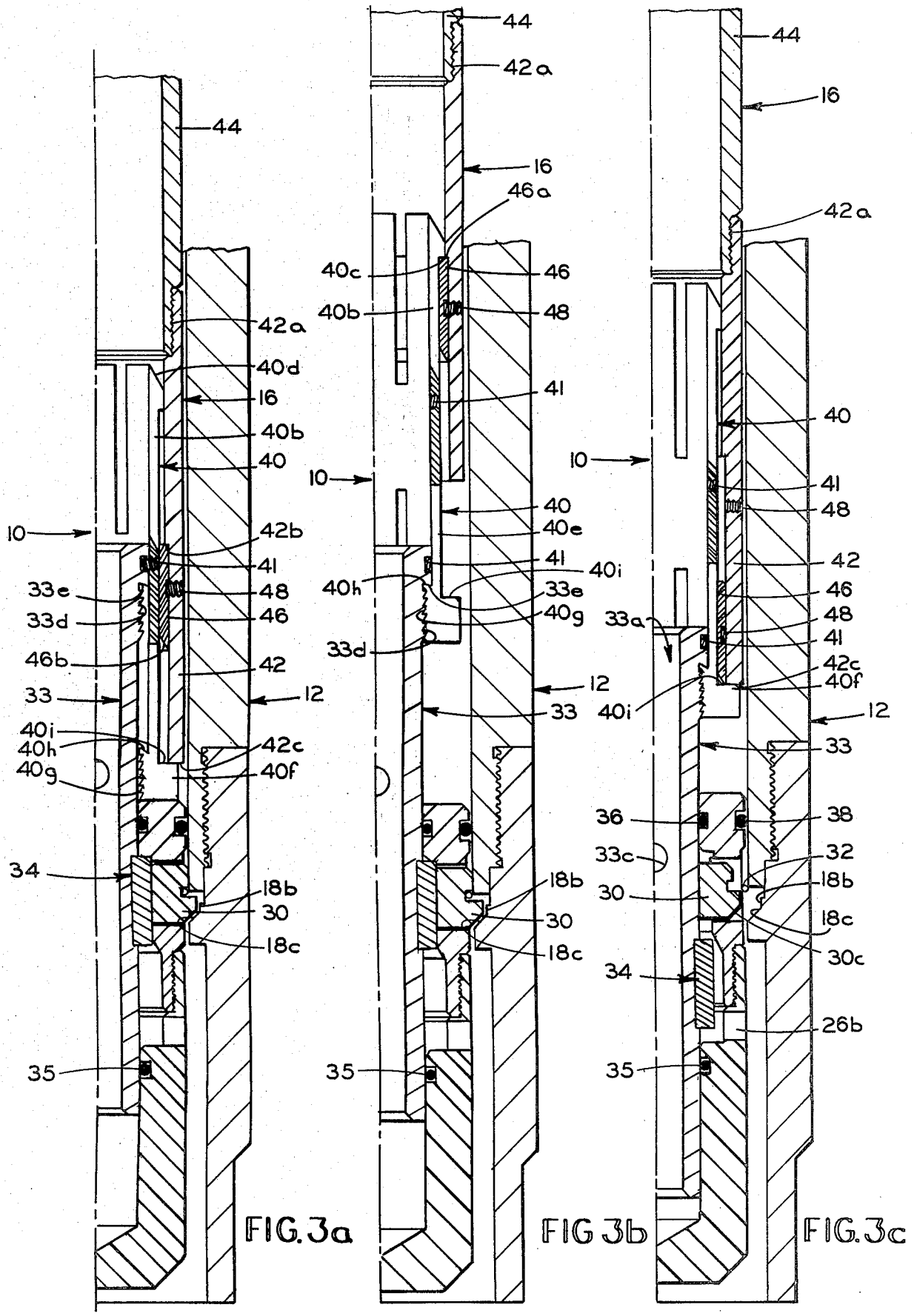
FIG. 3*a* is a quarter sectional view, showing the plug in its locked position with a tubing guide positioned over the upper end thereof.
FIG. 3*b* is a quarter sectional view, similar to FIG. 3*a*, but showing the relative position of the collet sleeve and the tubing guide after the connecting pin between the mandrel and the collet sleeve has been sheared.
FIG. 3*c* is a quarter sectional view, similar to FIGS. 3*a* and 3*b*, but showing the relative positions of the plug components after the mandrel has been shifted downwardly to retract the locking segments.

A longitudinally extending mandrel 33 having a central passageway 33*a* is adapted to slidably engage an upper cylindrical bore hole 24*c* in the upper locking segment portion 24 and a lower cylindrical bore hole 26*a* in the lower plug portion 26. A vertically shiftable member such as a split sleeve 34 consisting of half sections 34*a* and 34*b* are affixed to mandrell 33 at a reduced diameter portion 33*b* of the mandrel. The mandrel 33 is axially shiftable relative to the housing 22 from an upper position, as shown in FIGS. 1, 3*a* and 3*b*, to a lower position, as shown in FIG. 3*c*. When the mandrel 33 is in its uppermost position, the split sleeve 34 mounted thereon maintains the locking segments 30 in a radially outward, locked position such that the annular ribs 30*b* of the segments 30 are received within a cooperating annular groove 18*b* having an upwardly facing inclined surface 18*c* formed in the packer assembly 12 to securely lock the plug 10 within the packer against vertical movement. When the inner mandrel 33 and the split sleeve 34 are shifted longitudinally downwardly, as discussed, the locking segments 30 are able to move radially inwardly under the bias of snap ring 32 and hence out of the groove 18*b* to release the plug 10 from the packer assembly 12.

The plug assembly 10 is provided with a seal means for preventing fluid flow through the interior of the packer assembly when the plug is in its locked position. Such seal means includes a first O-ring 35 which is sealingly mounted between the bore hole 26*a* and the outer wall of the lower end of the mandrel 33, a second O-ring 36 which is sealingly mounted between the bore hole 24*c* and the outer wall of the upper end of the mandrel 33, and a third O-ring 38 which is sealingly mounted between the outer wall of the housing 24 and the inner wall of the packer assembly 12. The mandrel 33 is provided with a port hole 33*c* and the lower plug portion 26 is provided with port holes 26*b* which, as will be discussed, are utilized to equalize the differential fluid pressure across the plug during the releasing operation of the plug.

The plug 10 further includes a positioning means such as a collet sleeve 40 which is positioned over the upper end of the mandrel 33. The collet sleeve 40 has an intermediate cylindrical ring portion 40*a* which is releasably secured to the upper end of the mandrel 33 by means of a threaded shear pin 41. The collet 40 is provided with a plurality of circumferentially spaced, upwardly extending collet arms 40*b*, each having an outer annular segment shoulder portion 40*c* formed on the upper end thereof which extends upwardly and inwardly to form an upwardly facing bevelled surface 40*d*.

The collet sleeve 40 also includes a plurality of circumferentially spaced, downwardly extending collet arms 40*e* each having an enlarged lower end 40*f* adapted to abuttingly engage the upper face of the housing 24. Thus the mandrel 33 is held in its upper position. The lower ends 40*f* of the collet arms 40*e* are each provided with a series of internal wicker threads 40*g* which are adapted to cooperate with a series of external wicker threads 33*d* formed on the upper end of the mandrel 33. The internal wickers 40*g* extend upwardly and terminate in a downwardly facing shoulder 40*h*, while the external wickers 33*d* on the mandrel 33 extend upwardly and terminate in a downwardly facing shoulder 33*e*. This construction permits the collet wickers 40*g* to be ratcheted upwardly onto the mandrel wickers 33*d* until the engagement of the shoulders 33*e* and 40*h*, but prevents any subsequent relative axial movement between the collet sleeve 40 and the mandrel 33.

As shown in FIGS. 3*a* through 3*c*, the actuating sleeve 16 includes a hollow main body portion 42 having an upper end threadably secured at 42*a* to the lower end of a tubing string 44 which extends downwardly from the well head. The main body portion 42 surrounds a locating sleeve 46 which is releasably secured to the inner wall of the main body portion 42 by means of a threaded shear pin 48. The main body portion has an downwardly facing inner shoulder 42*b* which engages the upwardly facing end surface 46*a* of the sleeve 46 to prevent upward axial movement of the sleeve 46 relative to the main body portion 42. The locating sleeve 46 has a downwardly facing bevelled surface 46*b* formed on the lower end thereof. As will be discussed, the shear pin 48 requires a greater shearing force than the shear pin 41 connecting the mandrel 33 and the collet sleeve 40.

OPERATION

Initially, the plug 10 and the packer 12 are assembled at the well head as one unit with the locking segments 30 expanded radially outwardly into the annular groove 18*b* of the packer. The entire unit is then lowered down the well casing on a tubing string and the packer assembly 12 is secured at a selected location along the well casing 14, which location is typically between an upper and lower production zone of a well. Once secured, the plug 10 and the packer 12 will provide fluid isolation between the upper and lower production zones to permit independent production or treatment of the two zones.

It should be noted that the force generated by any pressure differential across the plug 10 will be resisted by the engagement of the locking segments 30 with the annular groove 18*b* in the packer 12. The split sleeve 34 will maintain the locking segments 30 within the groove 18*b* as long as the mandrel 33 is in its uppermost position. The mandrel is prevented from shifting downwardly to release the plug by the collet sleeve 40 and the shear pin 41. It should also be noted that, both the upper and lower ends of the mandrel 33 are exposed to the same fluid pressure, i.e., the fluid pressure above the plug 10, and because equal pressures are acting on surfaces having the same area. The axial fluid pressure forces acting on the mandrel 33 therefore are essentially balanced such that the tendency for the mandrel 33 to be urged downwardly by the fluid pressure to retract the locking segments is minimized.

When it is desired to expend the plug 10 from the packer assembly 12 in order to reach the production zone below the plug, a control element or work string such as the tubing string 44 is lowered down the well casing 14 with the actuating sleeve 16 attached to the lower end thereof. The sleeve 16 is then run over the upper end of the collet sleeve 40 until the bevelled surface 46*b* on the locating sleeve 46 contacts the bevelled surface 40*d* at the upper end of the collet sleeve 40. Downward movement of the actuating sleeve 16 causes the upper collet arms 40*b* to momentarily collpase radially inwardly such that the locating sleeve 46 slides onto the collet sleeve 40. Further downward movement of the actuating sleeve 16 results in the extreme lower end 42*c* of the main body portion 42 engaging an upwardly facing surface 40*i* of each of the lower ends 40*f* of the collet sleeve 40, as shown in FIG. 3*a*.

When the actuating sleeve 16 has contacted the lower end 40*f* of the collet sleeve 40, the plug 10 will resist any further downward movement of the actuating sleeve 16 and the tubing string 44. In accordance with the present invention, the operator at the well head can be assured that the tubing guide has contacted the plug 10 by lifting the tubing string upwardly, such that the upper end surface 46*a* of the locating sleeve 46 will contact the shoulder portions 40*c* formed at the upper ends of the collet arms 40*b*. At this time, a first predetermined amount of upward force applied to the actuating sleeve 16 causes the pin 41 to shear, so that the collet sleeve 40 is moved axially upwardly relative to the mandrel 33. Such shearing provides the operator with a reliable signal that the tubing string is in engagement with the plug 10. As the sleeve 40 is pulled upwardly, the wicker threads 40*g* at the lower end of the lower collet arms 40*e* will be ratcheted onto the wicker threads 33*d* formed at the upper end of the mandrel 33. Further upward movement of the collet sleeve 40 will stop when the upwardly facing shoulder 40*h* engages the downwardly facing shoulder 33*e*, as shown in FIG. 3*b*.

After the collet sleeve 40 and the mandrel 33 have been secured together by wicker threads 40*g* and 33*d*, a second predetermined amount of upward force is required to shear the pin 48 and thus release the actuating sleeve 16 from the plug 10. By monitoring the upward force required to shear either or both of the pins 41 or 48, the operator can be assured that the actuating sleeve 16 has engaged the plug 10. If the tubing string is then lifted from the well casing the operator can be further assured that the actuating sleeve 16 has contacted the plug 10 by examining the actuating sleeve 16 after it has been removed from the well casing to determine whether the locating sleeve 46 has remained downhole.

The actuating sleeve 16 is then re-lowered down the well casing 14 until the lower end 42*c* of the main body 42 contacts the upper surfaces 40*i* of the lower ends 40*f* of the collet sleeve 40. Further downward movement of the actuating sleeve 16 causes the interlocked collet sleeve 40 and the mandrel 33 to be shifted axially downwardly such that the split sleeve 34 is moved out of engagement with the locking segments 30, as shown in FIG. 3*c*. As the tubing string is moved downwardly, the locking segments 30 are urged radially inwardly by the engagement of the inclined surfaces 30*c* with the inclined surface 18*c* of the groove 18*b* and by snap ring 32. The plug assembly 10 is released from engagement with the packer assembly 12 and can then free fall within the well casing 14 to the bottom of the well.

It should be noted that after the mandrel 33 has been shifted axially downwardly, the port 33*c*, which has previously been located above the O-rings 36 and 38 and thus exposed to the fluid source above the plug, will now be positioned below the O-rings 36 and 38 such that the fluid source below the plug is in fluid communication with the upper fluid source via the ports 26*b* and 33*c* and the mandrel central passageway 33*a*. Consequently, if there is any differential pressure between the upper and lower fluid sources, this pressure can be equalized in order to facilitate the disengagement of the locking segments 30.

If for some reason the latching assembly cannot be released by use of the lower end of the tubing string as a control element in the manner prescribed, the latching assembly can be released by other means. A member having a radial dimension less than the inner diameter of upstanding collet figures 40*b* can be inserted between the collet fingers to abut the upper end of mandrel 33. A downward jarring force applied to mandrel 33 shears screw 41. The mandrel is then free to move downward relative to sleeve 40 to release locking members 30.

From the foregoing description, those skilled in the art will recognize that the method and apparatus of the invention may be applied to the expending of tools other than a plug, so long as such tool is freely insertable in the central bore of a packer, hanger or similar element in the well and has radially shiftable locking elements mounted on the body of the tool for securing the tool against vertical displacement with respect to the supporting packer or hanger. Similarly, while a specific application of the invention has been described in connection with the removal of an expendable plug assembly from a downhole hanger by utilization of a actuating sleeve secured to the bottom portions of a tubular production string, the release of any such expendable tool may also be accomplished through the mounting of the actuating sleeve on the end of a work string.

Although the invention has been described in terms of specified embodiments which are set forth in detail, it should be understood that this is by way of illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A latching assembly adapted to be secured to a tubular member in a subterranean well and subsequently released, comprising: radially shiftable locking means for engaging said tubular member in a first position to prevent relative vertical movement between said latching assembly and said tubular member; vertically shiftable means initially abutting said locking means for preventing radial movement thereof from said first position; vertically movable sleeve means, said locking means initially preventing vertical movement of said sleeve means in a first vertical direction; a mandrel, said sleeve means telescoping relative to said mandrel, said vertically shiftable means being affixed to said mandrel; and interlocking means between said vertically movable sleeve means and said mandrel for securing said mandrel to said sleeve means after movement of said sleeve means in a second vertical direction, subsequent movement of said interlocked sleeve means and mandrel, in the first vertical direction dislodging said vertically shiftable means to permit radial movement of said locking means to a second position in which said latching assembly is free to move vertically relative to said tubular member.

2. The latching assembly of claim 1 further comprising a shearable element for initially securing said mandrel to said sleeve means, said shearable element being sheared upon movement of said sleeve means in said second direction.

3. The latching assembly of claim 1 wherein said sleeve means further comprises end surfaces for engaging a control element for movement of said sleeve means in said second direction.

4. The latching assembly of claim 3 wherein said sleeve means comprises a collet having a solid ring portion slidable on said mandrel and mounting a shearable element initially securing said mandrel to said sleeve means, and upwardly extending arm portions, said end surfaces being on said arm portions and downwardly facing for engaging an upwardly facing surface on said control element for movement of said sleeve means in a second upward direction.

5. The latching assembly of claim 3 further comprising an actuating element adapted for connection to the bottom of the control element, said actuating element defining a shoulder for engaging said end surfaces for movement of said sleeve means in said second direction.

6. The latching assembly of claim 5 further comprising shearable means for connecting said actuating element to said control element and a shearable element for initially securing said mandrel to said sleeve means, said shearable means requiring the application of a greater force to shear than said shearable element, said shearable element and said shearable means both being shearable upon upward movement of said control element.

7. The latching assembly of claims 1, 2, 3, 4, 5 or 6 wherein said vertically shiftable means comprises a member positioned within a cooperable groove on said mandrel and extending radially beyond the surface of said mandrel.

8. The latching assembly of claims 1, 2, 3, 4, 5, or 6 wherein said interlocking means comprises ratcheting wicher threads on said sleeve means and on said mandrel.

9. An expendable tool assembly adapted to be secured within the central bore of a tubular member in a subterranean well and then expended downwardly into the lower portions of the well comprising: a hollow tool body freely insertable in the central bore of the tubular member and defining a vertical bore; radially shiftable locking means mounted on said hollow tool body and engagable with the tubular member preventing vertical movement of said tool body within the tubular member; a mandrel vertically slidable within said vertical bore; said mandrel being shiftable downwardly from a first position in engagement with said locking means to maintain said locking means in engagement with the tubular member, to a second position wherein said radially shiftable locking means may move out of engagement with the tubular member to expend said tool body; sleeve means including a shearable element for securing said mandrel to said sleeve means, and means on said sleeve means for connection to the bottom end of a control element whereby upward movement of the control element effects shearing of said shearable element with subsequent downward movement of said control element shifting said mandrel to said second position releasing said tool body.

10. The expendable tool of claim 9 wherein said sleeve means comprises a collet having a solid ring portion slidable on said mandrel and mounting said shearable element, and upwardly extending resilient arm portions having downwardly facing end surfaces adapted to engage an upwardly facing surface on the tubing string.

11. The expendable tool of claim 9 plus cooperating wicker threads on said sleeve means and said mandrel to permit upward movement of said sleeve means relative to said mandrel but preventing downward relative movement, and cooperating shoulders on said sleeve means and said mandrel limiting upward relative movement of said sleeve means, thereby interlocking said sleeve means and mandrel.

12. The expendable tool assembly of claim 9 further comprising a plurality of downwardly extending resilient arm portions on said sleeve means having their bottom surfaces abutting said tool body, cooperating wicker threads respectively on said mandrel and the inner surfaces of said downwardly extending resilient arm portions to permit upward movement of said sleeve means relative to said mandrel but preventing downward relative movement, and cooperating shoulders on said sleeve means and said mandrel limiting upward relative movement of said sleeve means thereby interlocking said sleeve means and mandrel.

13. An expendable plug assembly adapted to be assembled within a tubular member in a subterranean well, said plug assembly comprising: a hollow plug body defining a vertical bore; radially shiftable locking means mounted on said plug body and engagable with the tubular member for preventing vertical movements of said plug body within the tubular member; a mandrel vertically slidable within said hollow body bore, said mandrel being shiftable downwardly from a first position wherein said shiftable locking means is maintained in engagement with the tubular member, to a second position wherein said radially shiftable locking means is permitted to move inwardly out of engagement with the tubular member to expend said plug body; sleeve means including a shearable element for securing said mandrel to said sleeve means and means on said sleeve means for connection to the bottom end of a tubing string, whereby upward movement of the tubing string effects shearing of said shearable element with subsequent downward movement of said tubing string shifting said mandrel to said second position releasing said plug assembly.

14. The expendable plug assembly of claim 13 plus sealing means operative between said plug assembly and the tubular member to prevent fluid flow around said plug assembly.

15. The expendable plug assembly of claim 14 wherein said mandrel comprises a tubular element having a radial port therein, said hollow plug body having a radial fluid passage therein for alignment with said radial port thereby eliminating pressure differential forces on said mandrel, and sealing means operable between said plug body bore and said mandrel for preventing fluid flow around said mandrel.

16. An expendable tool assembly adapted to be secured within the central bore of a tubular member in a subterranean well and then expended downwardly into the lower portions of the well comprising: a hollow tool body freely insertable in the central bore of the tubular member and defining a vertical bore; radially shiftable locking means mounted on said hollow tool body and engagable with the tubular member for preventing vertical movements of said tool body within the tubular member; a mandrel vertically slidable within said vertical bore; said mandrel being shiftable downwardly from a first position in engagement with said locking means to maintain said locking means in engagement with the tubular member, to a second position wherein said radially shiftable locking means is permitted to move inwardly out of engagement with the tubular member to expend said tool body; sleeve means including a shearable element for securing said mandrel to said sleeve means; an actuating element adapted for connection to the bottom of a work string and insertable in the central bore of the tubular member, said actuating element defining an upwardly facing annular shoulder; and resilient means on said sleeve means engagable with said upwardly facing annular shoulder by downward relative movement of the working string, whereby subsequent upward movement of the work string effects shearing of said shearable element with subsequent downward movement of said mandrel to said second position releasing said tool body.

17. The expendable tool of claim 16 wherein said sleeve means comprises a collet having a solid ring portion slidable on said mandrel and mounting said shearable element, and said resilient means comprises upwardly extending resilient collet arm portions having downwardly facing end surfaces adapted to engage said upwardly facing shoulder on said actuating element.

18. The expendable tool of claim 16 further comprising cooperating wicker threads on said sleeve means and said mandrel to permit upward movement of said sleeve means relative to said mandrel but preventing downward movement, and cooperating shoulders on said sleeve means and said mandrel limiting upward relative movement of said sleeve means thereby interlocking said sleeve means and said mandrel.

19. The expendable tool assembly of claim 16 further comprising a plurality of downwardly extending resilient arm portions on said sleeve means having their bottom surfaces abutting said tool body, cooperating wicker threads respectively on said mandrel and the inner surfaces of said downwardly extending resilient arm portions to permit upward movement of said sleeve means relative to said mandrel but preventing downward movement, and cooperating shoulders on said sleeve means and said mandrel limiting upward relative movement of said sleeve means, thereby interlocking said sleeve means and said mandrel.

20. The expendable tool of claims 16, 17, 18, or 19 further comprising shearable means for connecting said actuating element to the work string, said shearable means requiring the application of a greater upward force to shear than said shearable element, thereby permitting the expending of said mandrel, sleeve means and actuating element with said tool body by shearing of said shearable means.

21. The expendable tool assembly of claim 9 or 16 further comprising resilient means for urging said radially shiftable locking means inwardly against said mandrel.

22. An expendable plug assembly adapted to be positioned within the central bore of a packer in a subterranean well, the plug being releasable after a work string engages the plug, upward movement of the work string being required before subsequent downward movement of the work string releases the plug assembly, said plug assembly comprising: radially shiftable locking means for engaging said packer along the central bore thereof in a first position to prevent relative movement between said plug assembly and said packer; vertically shiftable means initially abutting said locking means for preventing inward movement of said locking means; vertically movable sleeve means, said locking means initially preventing downward movement of said sleeve means; a mandrel, said sleeve means telescoping relative to said mandrel, said vertically shiftable means being affixed to said mandrel; and interlocking means between said vertically movable sleeve means and said mandrel for securing said mandrel to said sleeve means after upward movement of said sleeve means in response to movement of said work string, subsequent downward movement of said interlocked sleeve means and mandrel dislodging said vertically shiftable means to permit inward movement of said locking means to free and plug assembly from said packer.

23. The plug assembly of claim 22 wherein said interlocking means comprises ratcheting wicker threads on said sleeve means and on said mandrel.

24. A latching assembly adapted to be secured to a tubular member in a subterranean well and subsequently released, comprising radially shiftable locking means for engaging said tubular member in a first position to prevent relative vertical movement between said latching assembly and said tubular member; vertically shiftable means initially abutting said locking means for preventing radial movement thereof from said first position; vertically movable sleeve means, said locking means initially preventing vertical movement of said sleeve means in a first vertical direction; a mandrel having a diameter different from said sleeve means and telescoping relative to said sleeve means said vertically shiftable means being affixed to said mandrel; and interlocking means between said vertically movable sleeve means and said mandrel for securing said mandrel to said sleeve means after movement of said sleeve means in a second vertical direction; said latching assembly being freed to move vertically relative to said tubular member either after subsequent movement of said interlocked sleeve means and mandrel, in the first vertical direction dislodging said vertically shiftable means to permit radial movement of said locking means to a second position or upon movement of said mandrel in said first vertical direction relative to said sleeve means.

25. The method of locating and releasing an expendable tool secured in a well casing by outwardly extended radially shiftable locking lugs, comprising the steps of:

positioning a downwardly shiftable mandrel in engagement with the inner ends of the radially shiftable locking lugs, a shearable connection initially securing the mandrel to an actuating collet having upwardly projecting resilient arms;

providing an upwardly facing shoulder on the bottom of a work string;

lowering the work string into the well to engage the upwardly projecting collet arms with the upwardly facing shoulder;

raising the work string to apply sufficient upward force to the actuating collet arms to shear the shearable connection, thereby providing a signal to the operator; and lowering the work string to move the mandrel downwardly with respect to the locking lugs, permitting the locking lugs to move inwardly and free the tool for downward movement in the well.

26. The method of locating and releasing an expendable tool secured in a well casing by outwardly extended radially shiftable locking lugs, comprising the steps of:

positioning a downwardly shiftable mandrel in engagement with the inner ends of the radially shiftable locking lugs, a shearable connection initially securing the mandrel to an actuating collet having upwardly projecting resilient arms;

securing an actuating ring to the bottom of a work string by a shearable member having greater shear resistance than said shearable connection, the actuating ring defining upwardly facing annular surface;

lowering the work string into the well to engage the upwardly projecting collet arms with the upwardly facing shoulder;

raising the work string to apply sufficient upward force to the actuating collet arms to shear the shearable connection, thereby providing a signal to the operator;

continuing the upward movement of the work string to shear said shearable member, thereby providing the operator with a second signal; and lowering the work string to move the mandrel downwardly with respect to the locking lugs, permitting the locking lugs to move inwardly and free the tool for downward movement in the well.

* * * * *